United States Patent [19]

Chu et al.

[11] 4,041,819

[45] Aug. 16, 1977

[54] LEAD-IN DEVICE FOR BI-LEVEL SLITTER

[75] Inventors: Paul Chu, Amityville; Gunther Weiskopf, New York; Lawrence J. Saunders, Elmont, all of N.Y.

[73] Assignee: S & S Corrugated Paper Machinery Co., Inc., Brooklyn, N.Y.

[21] Appl. No.: 721,380

[22] Filed: Sept. 8, 1976

[51] Int. Cl.[2] ..... B31B 1/16; B26D 3/08; B26D 11/00

[52] U.S. Cl. ..... 83/302; 83/102; 83/408; 93/58.2 R

[58] Field of Search ..... 83/102, 302, 408, 106, 83/9; 93/1 G, 58 R, 58.2 R

[56] References Cited

U.S. PATENT DOCUMENTS

| | | | |
|---|---|---|---|
| 3,264,917 | 8/1966 | Califano et al. | 83/408 X |
| 3,307,441 | 3/1967 | Saunders et al. | 83/302 |
| 3,831,502 | 8/1974 | Tokuno | 83/302 X |
| 3,882,765 | 5/1975 | Tokuno | 83/302 X |

*Primary Examiner*—Donald R. Schran
*Attorney, Agent, or Firm*—Ostrolenk, Faber, Gerb & Soffen

[57] ABSTRACT

Apparatus for producing sheets of corrugated board from a moving web includes stationary upper and lower slitter devices for slitting the web longitudinally into a plurality of narrow webs and means for leading each of these narrow webs to a selected one of three cutoff devices located at different heights. The means for leading the narrow webs to the cutoff includes stationary director-support means and presettable automatic lead-in table elements that are selectively operable between three positions. The lead-in table elements are also operable as a group to a raised position wherein they are retracted so as to permit a workman to clear jams or otherwise service the apparatus.

14 Claims, 3 Drawing Figures

AUTO
LEAD-IN
DEVICE
27

LEAD-IN DEVICE FOR BI-LEVEL SLITTER

This invention relates to apparatus for producing sheets of corrugated board and more particularly relates to means for selectively operating a moving corrugated board from a bilevel slitter to a triplex cutoff.

U.S. Pat. No. 3,307,441, issued Mar. 7, 1967 to L. J. Saunders, et al for a Machine For Slitting and Transversely Cutting Corrugated Board illustrates preset automatic lead-in tables for directing webs of corrugated board to selected sections of a triple cutoff. The webs are formed by a slitter which operates in a manner such that its output is always at the same level. In copending application Ser. No. 648,665, filed Jan. 13, 1976 by S. S. Flaum et al for a Slitter Having Carrier for Selective Adjustment Of a Plurality of Heads, and assigned to the assignee of the instant invention, there is described a duplex slitter in which the slitter sections are stationary and the outputs from each of these sections are at different levels.

In accordance with the instant invention, automatic lead-in means is provided for directing webs from feed paths at different levels to selected sections of a triple cutoff. The lead-in means includes stationary director-support elements interposed between ramps leading to individual cutoffs, located one above the other, and two sets of presettable automatic lead-in tables. The individual slats or tables of each set are selectively operable to three different positions. The stationary director-support elements are arranged with a main central section and auxiliary sections disposed upstream and downstream of the main section. The director-support elements are arranged so that in conjunction with the lead-in tables each web is directed toward a lead-in ramp for a selected cutoff.

In order to permit direct access to interior sections of the lead-in means for servicing and/or clearing jams, means are provided for raising the lead-in table elements for the upper slitter to a retracted or servicing position. In this same vein means are provided for lowering the lead-in table elements for the lower slitter to a retracted or servicing position. When these elements are in their servicing positions the lead-in tables are spaced from the director-support elements by a distance sufficient to permit an operator to walk upright between the lead-in tables and the director-support elements.

Accordingly, a primary object of the instant invention is to provide novel lead-in means for directing webs from slitter outputs at either one of two levels to cutoff inputs at any one of three levels.

Another object is to provide lead-in means of this type which includes stationary director-support elements located downstream of two sets of presettable automatic lead-in tables.

Still another object is to provide lead-in means of this type in which the automatic lead-in table elements are operable as a group to a retracted position wherein interior portions of the lead-in means are accessible for servicing and the clearing of jams.

These objects as well as other objects of this invention shall become readily apparent after reading the following description of the accompanying drawings in which.

Figures 1, 2, 3:
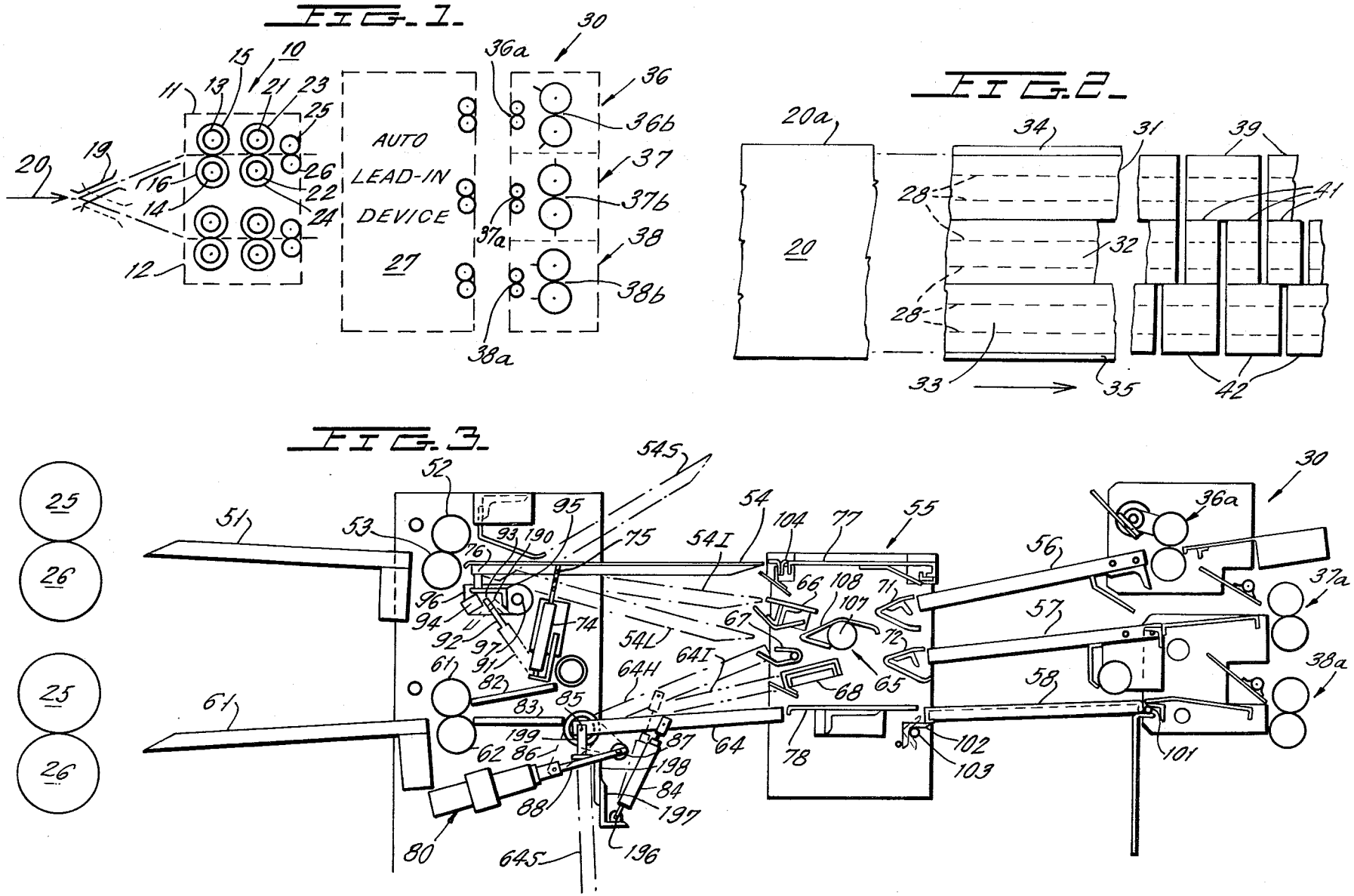
FIG. 1 is a side elevation in schematic form showing apparatus for producing sheets of corrugated board including a bilevel slitter, lead-in means and a triple cutoff.
FIG. 2 is a plan view of corrugated board as it passes through the various sections of the apparatus illustrated in FIG. 1.
FIG. 3 is a side elevation in schematic form showing details of the lead-in means of FIG. 1.

Now referring to the Figures and more particularly to FIGS. 1 and 2, power adjusted bilevel slitter 10 is of the type described in detail in the aforesaid copending application Ser. No. 648,665, and includes upper 11 and lower 12 slitter stations that are essentially of the same construction. Each includes a pair of shafts 13, 14 which carry a plurality of pairs of scorer heads 15, 16. In addition, each station 11, 12 also includes another pair of shafts 21, 22 which carry a plurality of pairs of slitter heads 23, 24. A relatively wide corrugated web 20 issuing from a double backer (not shown) moves from left to right with respect to FIG. 1 and is directed to one or the other of slitter stations 11, 12 by guide 19 that is selectibly operable from the upper solid line position of FIG. 1 to the lower phantom position.

With guide 19 in the solid line position shown, wide web 20 is directed to upper slitter station 11 between pairs of scoring heads 15, 16 and between pairs of slitting heads 23, 24 to the nip between takeoff rollers 25, 26 into automatic lead-in device 27 of a construction which shall be described in detail hereinafter. Scorer heads 15, 16 apply score lines 28 to web 20 and slitter heads 23, 24 cut web 20 into relatively narrow webs 31, 32, 33 and also trim edges 34, 35. Web 31 is directed to the feed rolls **36*a* for knife bars 36*b* of upper cutoff 36 which forms part of triple cutoff 30. Cutoff 36 cuts web 31 transversely into equal length sheets 39. In a similar manner, narrow webs 32, 33 are directed to feed rolls 37*a*, 38*a* and knife bars 37*b*, 38*b* of middle and lower cutoffs 37, 38, respectively, to produce sheets 41 from web 32 and sheets 42 from web 33.**

For a more detailed description of lead-in device 27 reference is made to FIG. 3 which shows output ramp 51 extending between upper takeoff rollers 25, 26 and upper infeed rollers 52, 53 which feeds web material to the upper surface of upper lead-in table 54. The downstream end of table 54 is adjacent the upstream end of director-support means 55 whose downstream end supplies the upper, intermediate and lower feed-in ramps 56, 57, 58 for the respective cutoffs 36, 37, 38.

Lower takeoff ramp 61 is positioned to support webs issuing from lower takeoff rollers 25, 26 and direct such webs to rollers 61, 62 feeding lower lead-in table 64 whose downstream end is at the upstream end of director-support means 55. The latter includes stationary centrally located main sections 65; upper, intermediate and lower upstream auxiliary sections 66, 67, 68; upper and lower downstream auxiliary sections 71, 72 aligned with the respective lead-in ramps 56, 57, and upper and lower through supports 77, 78 each having a central main section and auxiliary end sections.

In a construction known to the art, each of the lead-in tables 54, 64 comprises a plurality of spaced parallel slats or elements extending in the direction of web travel. Each slat of upper lead-in table is movable individually about pivot 76 at the upstream end of table 54 and each of these slats is in gravity induced engagement with an individual power cylinder 74 operable between three positions. In the first of these positions piston rod extension 75 is fully retracted so that lead-in table 54 is moved about pivot 76 to its low position 54L. With extension 75 in its intermediate position slat 54 is pivoted counterclockwise about pivot 76 to the intermediate position 54I, and when extension 75 is fully projected slat 54 is pivoted to its high position, or solid line position of FIG. 3, aligned with upper through support 77. Similarly, each slat of lower lead-in table 64 is provided with an individual power cylinder 84 for selective movement about upstream pivot 85 from the solid line low position to the intermediate position 64I and to the high position 64H.

With the upper lead-in table in its high position 54 a web issuing from upper takeoff rolls 25, 26 is directed to upper cutoff 36 along a path consisting of ramp 51, feed rolls 52, 53, table 54, upper through director 77, and upper lead-in ramp 56. With the upper lead-in table in its intermediate position 54I a web is led from upper takeoff rolls 25, 26 to intermediate cutoff 37 along a path defined by ramp 51, feed rolls 52, 53, lead-in table 54I, above directors 66, 65 and below director 71, and intermediate lead-in ramp 57. With the upper lead-in table in its low position 54L a web is led from upper takeoff rolls 25, 26 to lower cutoff 38 along a path defined by ramp 51, feed rolls 52, 53, lead-in tables 54I, above directors 67, 68 and below directors 65, 72, and lower feed-in ramp 58.

With the lower lead-in table in its low position 64, a web is led from lower takeoff rolls 25, 26 to lower cutoff 38 along a path including ramp 61, feed rolls 61, 62, support 83, lead-in tables 64, lower through director 78, and lower ramp 58. With the lower lead-in table in its intermediate position 64I a web is led from lower takeoff rolls 25, 26 to intermediate cutoff 37 along a path including ramp 61, feed rollers 61, 62, guide 83, lead-in table 64I, above directors 68, 72 and below directors 67, 65, and intermediate lead-in ramp 57. With the lower lead-in table in its raised position 64H a web is guided from lower takeoff rolls 25, 26 to upper cutoff 36 along a path including ramp 61, feed rolls 61, 62, above guide 83 and below guide 82, lead-in table 64H, above directors 65, 71 and below director 66, and upper lead-in ramp 56.

In order to facilitate servicing and to facilitate the clearing of jams, all of the slats of lower feed-in table 64 are movable downward simultaneously about pivot 85 to a servicing position 64S below position 64. This is accomplished by providing crank 86 keyed to pivot 85 and pivotally mounted at pin 87 to the free end of piston rod extension 88 protruding from the right end of power cylinder 80. Also keyed to pivot 85 are radial extensions 199 connected to opposite ends of transverse angle 198 which is connected to another transverse angle 197 which supports pivot 196 to which the lower ends of all cylinders 84 are connected. When cylinder 80 is actuated to retract extension 88 to the left, crank 86 is pivoted clockwise to operate pivot 85, and elements 199, 198, 197, 196, 84 keyed directly or indirectly thereto, clockwise thereby operating all of the slats of lead-in tables 64 to the lowered or servicing position 64S. In this servicing position, there is a sufficient gap between lead-in tables 64 and director-support means 55 for service personnel to pass therebetween.

In a similar manner, all of the slats of lead-in table 54 are operable simultaneously to a raised or servicing position 54S above the highest operating position for lead-in tables 54. This is accomplished by providing power cylinder 91 having piston extension 92 connected at point 93 to bracket 94. The latter is secured to transverse angle 95 which extends parallel to and supports pivot rod 76. The ends of angle 95 are secured to plates 96 which are mounted on pivot 97. In order to raise all slats of upper lead-in table 54 to their service positions 54S, power cylinder 91 is actuated so as to retract extension 92 thereby pivoting angle 95 counterclockwise about center 97 to the phantom position shown engaging all of the slats of lead-in table 54 at point 190 and thereby move them to their fully raised position 54S.

To further facilitate the clearing of jams and to facilitate access to cutoffs 36–38, lead-in ramps 56, 57 are cantilevered at their downstream end and are removable. Lower lead-in ramp 58 is mounted on pivot 101 located at the downstream end of ramp 58. Support angle 102 is tiltable on pivot 103 to permit the upstream end of ramp 58 to drop.

Upper through director 77 is mounted on upstream hinge 104 thereby permitting through director 77 to be pivoted counterclockwise. The other director-support elements are constructed of a transverse structural member to which is secured one or more sheet metal elements. Thus, main director-support 65 includes bar 107 of circular cross-section to which is mounted sheet metal element 108 which actually engages webs as they pass through director-support means 55. Similarly, elements 66, 71 and 72 are provided with transverse angle irons which support sheet metal elements, director-support element 67 includes a circular transverse support rod, and director-support element 68 includes a transverse channel. Where necessary the sheet metal elements of director-support means 55 are notched to permit free passage of the slats forming lead-in tables 54, 64 during movement of these slats between their uppermost and lowermost positions.

It is noted that the upper and lower lead-in tables 54, 64 may have sets of presettable means automatic means to control adjustment. Such presettable means is described in U.S. Pat. No. 3,307,441. However, it is more likely that the controls for operating the individual slats will be operated so as to cause the slats to move at different times, with the slats of one of the lead-in tables 54, 64 being adjusted while the other of these lead-in tables 54, 64 is in use.

Although there has been described a preferred embodiment of this novel invention, many variations and modifications will now be apparent to those skilled in the art. Therefore, this invention is to be limited, not by the specific disclosure herein, but only by the appending claims.

The embodiments of the invention in which an exclusive privilege or property is claimed are defined as follows:

1. Apparatus for producing sheets from a moving web including:

upper and lower slitter means for longitudinally cutting a longitudinally moving wide web into a plurality of narrower webs;

upper lead-in table means operatively positioned to support webs issuing from said upper slitter means;

lower lead-in table means operatively positioned to support webs issuing from said lower slitter means;

upper and lower cutoff means downstream of said slitter means for transversely cutting webs into sheets;

upper and lower lead-in ramp means operatively positioned upstream of the respective upper and lower cutoff means to direct webs thereto;

each of said upper and lower lead-in table means being selectively operable independently between a lower position for directing webs toward said lower ramp means, and an upper position for directing webs toward said upper ramp means;

and director-support means intermediate said lead-in table means and said lead-in ramp means for guiding and supporting webs in the region between the table means and the ramp means.

2. Apparatus as set forth in claim 1 also including: an intermediate cutoff means downstream of said slitter means for transversely cutting webs into sheets;

said intermediate cutoff means being operatively positioned at a height between that of said upper and lower cutoff means;

intermediate lead-in ramp means operatively positioned upstream of said intermediate cutoff means to direct webs thereto;

each of said upper and lower lead-in table means also being selectively operable to an intermediate position for directing webs toward said intermediate ramp means.

3. Apparatus as set forth in claim 2 in which the director-support means includes:

a main section for supporting from below webs extending between said lower lead-in table means in its upper position and said upper ramp means;

said main section also directing from above webs extending between said upper lead-in table means in its lower position and said lower ramp means;

said main section being operatively positioned below webs extending between said upper lead-in table means in its intermediate position and said intermediate ramp means;

said main section also being operatively positioned above webs extending between said lower lead-in table means in its intermediate position and said intermediate ramp means.

4. Apparatus as set forth in claim 3 in which the director-support means also includes:

an auxiliary section upstream of said main section and including lower, intermediate and upper portions;

said lower portion being operatively positioned to support from below webs extending between said lower lead-in table means in its said intermediate position and said intermediate ramp means;

said upper portion being operatively positioned to support from below webs extending between said upper lead-in table means in its said intermediate position and said intermediate ramp means;

said intermediate portion being operatively positioned to support from below webs extending between said upper lead-in table means in its said lower position and said lower ramp means.

5. Apparatus as set forth in claim 4 in which the intermediate and upper ramp means are each upwardly inclined in a downstream direction.

6. Apparatus as set forth in claim 4 in which the director-support means further includes:

another auxiliary section downstream of said main section and including another upper and another lower portion;

said another upper portion being operatively positioned to direct from above webs extending between said upper lead-in table means in its intermediate position and said intermediate ramp means;

said another lower portion being operatively positioned to support from below webs extending between said lower lead-in table means in its intermediate position and said intermediate ramp means.

7. Apparatus as set forth in claim 6 in which the intermediate and upper ramp means are each upwardly inclined in a downstream direction.

8. Apparatus as set forth in claim 4 in which the intermediate portion also directs from above webs extending between said lower lead-in table means in its intermediate position and said intermediate ramp means.

9. Apparatus as set forth in claim 8 in which the upper portion also directs from above webs extending between said lower lead-in table means in its upper position and said upper ramp means.

10. Apparatus as set forth in claim 8 in which:

said another lower portion also directs from above webs extending between said upper lead-in table means in its lower position and said lower ramp means;

said another upper portion also supporting from below webs extending from said lower lead-in table means in its upper position and said upper ramp means.

11. Apparatus as set forth in claim 1 including power operated means for moving said upper and lower lead-in table means to servicing positions spaced sufficiently from said director support means to permit service personnel to enter between said lead-in table means and said director-support means.

12. Apparatus as set forth in claim 1 also including first means for operating said upper lead-in table means to a servicing position above its said upper position and second means for operating said lower lead-in table means to a servicing position below its said lower position.

13. Apparatus as set forth in claim 4 also including first means for operating said upper lead-in table means to a servicing position above its said upper position and second means for operating said lower lead-in table means to a servicing position below its said lower position.

14. Apparatus as set forth in claim 1 in which the lower lead-in table means in its upper position being fully below a web being directed toward the lower ramp means by the upper lead-in table means in its lower position, and the upper lead-in table means in its lower position being fully above a web being directed toward the upper ramp by the lower lead-in table means in its upper position.

* * * * *